United States Patent [19]

Emenegger

[11] 4,321,438

[45] Mar. 23, 1982

[54] SAFETY SWITCH FOR VEHICLE ELECTRICAL SYSTEM

[76] Inventor: Ray Emenegger, 19 Coronado Cir., Santa Rosa, Calif. 95405

[21] Appl. No.: 161,927

[22] Filed: Jun. 23, 1980

[51] Int. Cl.[3] ..... H01H 35/00

[52] U.S. Cl. ..... 200/61.45 R; 200/61.48; 200/61.5

[58] Field of Search ..... 200/52 A, 61.45 R, 61.45 M, 200/61.48, 61.49, 61.50, 61.51, 61.52

[56] References Cited

U.S. PATENT DOCUMENTS

| | | | |
|---|---|---|---|
| 1,651,919 | 12/1927 | Douglas | 200/52 A |
| 2,262,917 | 11/1941 | Brooks | 200/61.5 |
| 2,391,129 | 12/1945 | Chambers | 200/61.48 X |
| 2,445,873 | 7/1948 | Chambers | 200/61.48 |
| 2,721,237 | 10/1955 | Yunker | 200/61.49 |
| 2,802,204 | 8/1957 | Kennelly et al. | 200/61.45 M |
| 2,806,915 | 9/1957 | Fowler | 200/61.45 R |
| 3,073,922 | 1/1963 | Miller | 200/61.48 |

*Primary Examiner*—James R. Scott

*Attorney, Agent, or Firm*—Naylor, Neal & Uilkema

[57] ABSTRACT

A pendulum-like, impact-responsive switch is provided to disconnect the battery from the electrical system of a car in the event of a collision to thereby prevent the ignition by sparking wires of fuel and other flammable material.

Means are provided to control the force-level responsiveness of the pendulum-like member and to hold the member in de-activated position.

4 Claims, 5 Drawing Figures

SAFETY SWITCH FOR VEHICLE ELECTRICAL SYSTEM

BACKGROUND OF THE INVENTION

Automobiles involved in crashes frequently catch fire and trap and burn the occupants. This is usually caused by the release of gasoline in the vicinity of a sparking wire resulting from a rupture of some part of the car's electrical system and from the fact that the ruptured electrical system is still connected to the battery.

For example, a rear-end collision which tears loose and ruptures the car's gas tank typically ruptures the electrical line which is connected to the gas level gauge. This broken line sparks as long as it remains connected to the car battery.

There is a popular belief that a gasoline fire may arise when raw gasoline pours onto a heated engine block. This, however, is a false belief as the flash point of gasoline is considerably higher than the temperature at its hottest of an engine block.

The vast majority of fires in crashed automobiles results from the exposure of a "hot" wire and from the fact that the exposed wire remains electrically connected to the car battery.

SUMMARY OF THE INVENTION

The principal object of the invention is to provide a safety switch means which is operable as a result of an abrupt change in the momentum of a car of the magnitude resulting from front and rear-end collisions to instantaneously disconnect the battery from the balance of the electrical system of the car.

This is accomplished by installing in the car in close vicinity to the battery a pendulum type switching member adapted to swing forward in the event of a front-end collision and to swing rearward in the event of a rear-end collision and in each case to disconnect the battery from the rest of the electrical system. The pendulum element is preferably an inverted pendulum element which serves as an electrical connector between the battery and the rest of the electrical system when the pendulum element is in a vertical position.

Means are provided for retaining the pendulum element in actuated position. Means are also provided to adjustably control the amount of impact force required to actuate the switch, thereby ensuring that the switch will not be actuated by any sudden braking stop or by any rapidly accelerated start-up movement of the car.

Other objects and advantages of the invention will be apparent from the following description taken with the drawing forming part of this application.

DESCRIPTION OF THE PREFERRED EMBODIMENT

Figure 1:
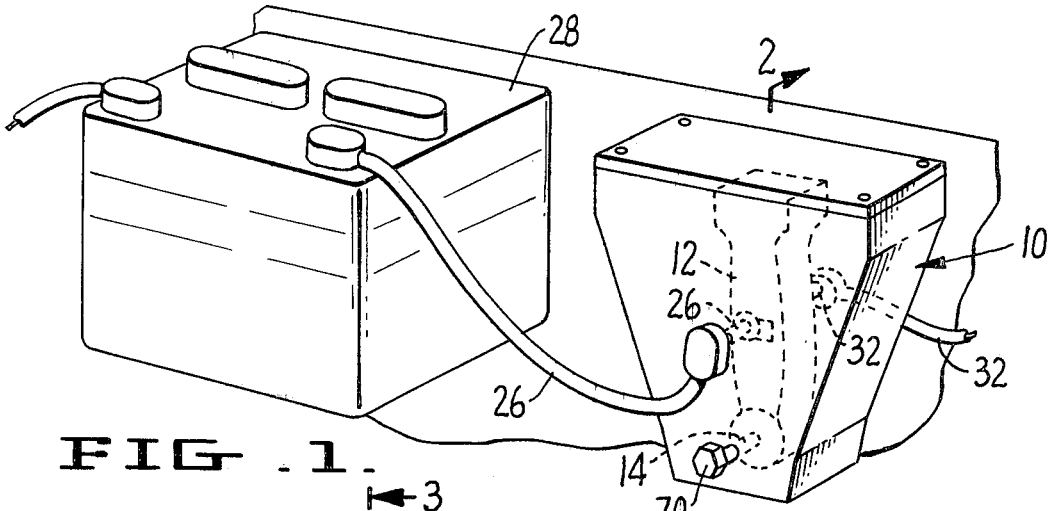
FIG. 1 is a view in perspective showing the subject switch and a car battery in connected relation to each other.
Figure 2:
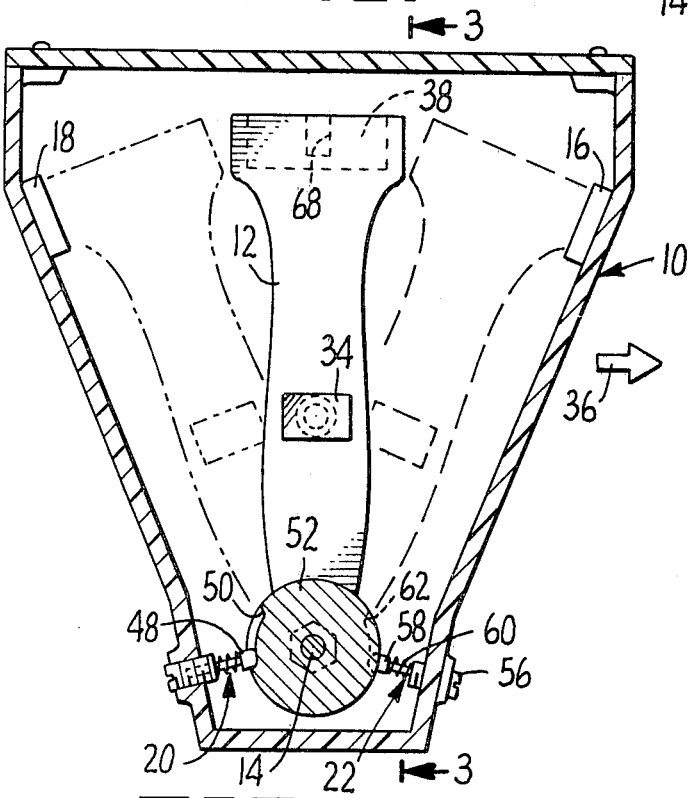
FIG. 2 is an enlarged view taken along lines 2—2 of FIG. 1.
Figure 3:
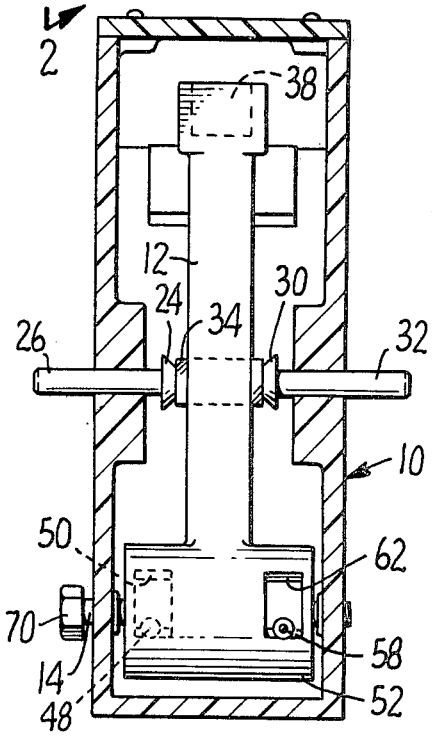
FIG. 3 is a view taken along lines 3—3 of FIG. 2.
Figure 4:
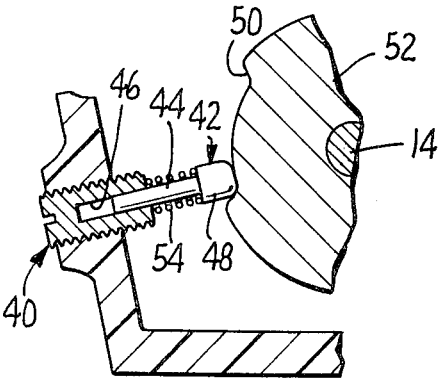
FIG. 4 is an enlarged detail view of the adjustment means provided to control the operation of the switch in a front-end collision.

The switch comprises housing 10, pendulum arm 12, shaft 14, holding magnets 16 and 18, front and rear impact adjustment means 20 and 22, contact 24 which is connected through lead 26 to battery 28, contact 30 which is connected through lead 32 to the rest of the electrical system, not shown, of the car and a conductor carried by the arm 12 and operable to interconnect the contacts 24 and 30 when the arm is in its normal upright position.

The housing 10 is preferably made of clear plastic. It is fixedly attached to the car adjacent the battery so that the axis of shaft 14 is at a right angle to the line of normal movement of the car. Direction arrow 36 indicates the direction of forward movement of the car.

The magnet-contacting upper end of the arm 12 is made of steel. It is provided with a lead filling 38 to locate the center of gravity of the arm further away from its center of rotation and thereby increase the responsiveness of the arm to movement under the effect of collision forces.

Adjustment means 20 comprises adjustment plug 40 threadably engaged with the housing, a detent member 42 having a stem end 44 slidably engaged within the passage 46 of plug 40, head 48 carried by the stem 44 and having a rounded end which rides within slot 50 formed in hub 52 of arm 12, and a compression spring 54 sleeved on the stem 44. Adjustment means 22 is similarly comprised of threaded plug 56, rounded head detent 58, compression spring 60 and slot 62 formed in hub 52.

Figure 5:
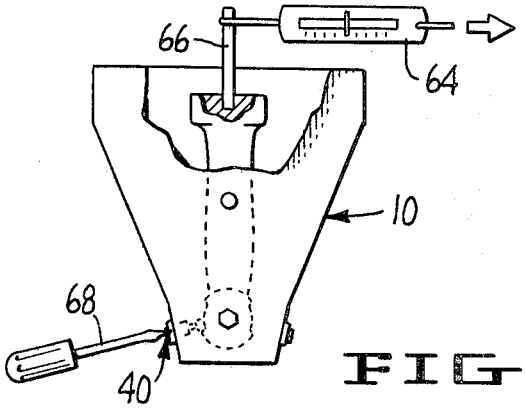
FIG. 5 is a semi-schematic view of the switch and of the means which are typically employed in setting the adjustment means.

FIG. 5 illustrates a way in which the switch may be pre-set to actuate at predetermined stopping down and starting up forces. A spring scale 64 is attached at one end to a post 66 which is removably disposed in a socket 68 provided in the lead filling 38. A given pulling force is applied to the other end of the scale 64. The plug 40 is then adjusted with screwdriver 68 so that the head 42 rides up out of slot 50 at the scale force setting. In a similar manner the switch is pre-set to operate in the rearward direction under the influence of a rear-end collision.

Upon the occurrence of a front-end collision or the equivalent thereof the arm 12 swings forwardly to take contact block 34 out of engagement with contacts 24 and 30, thereby disconnecting the battery from the balance of the electrical system of the car. The arm 12 is retained in its forwardly actuated position by the magnet 16.

Upon the occurrence of a rear-end collision the arm 12 swings rearwardly, causing detent 58 to ride up out of the slot 62, disconnecting contact block 34 from contacts 24 and 30, and becoming retained in its rearwardly actuated position by magnet 18.

When it is desired to reset the arm 12 to its vertical position the head 70 attached to shaft 14 may be engaged with a suitable tool to rotate the shaft 14 in the appropriate direction to return the arm 12 to its upright, normal position. The shaft 14 may also be manually rotated to move the arm 12 out of its vertical position and disconnect the car's electrical system from the battery.

It will be appreciated that upon the occurrence of a front or rear-end collision, or the equivalent of either of them, the arm 12 instantaneously swings to a circuit-breaking position, thereby de-energizing all of the various wires of the electrical system and preventing the occurrence of any electrical sparking or arcing and consequent igniting of any gasoline or oil fumes.

What is claimed is:

1. A collision-responsive safety switch for a vehicle operable to disconnect the battery from the rest of the electrical system of the vehicle when the vehicle collides with another vehicle or object, said switch comprising a lever arm disposed for pivotal movement about an axis which extends transversely of the normal path of movement of the vehicle, an electrical conductor extending transversely of said arm and movable with said arm, a pair of contact members, means supporting said members, said members being adapted to be interconnected by said conductor when said arm is in a vertical position, one of said contacts being connected to the battery of the vehicle and the other being connected to the rest of the electrical system of the vehicle, holding means and means positioning the same to selectively retain the arm at one end or the other of its arc of swing to maintain the battery and the rest of the electrical system in disconnected relation, and means for variably controlling the amount of force required to swing said arm to disconnect the battery from the rest of the electrical system.

2. A collision-responsive safety switch for a vehicle operable to disconnect the battery from the rest of the electrical system of the vehicle when the vehicle collides with another vehicle or object, said switch comprising a housing, a lever arm disposed within said housing for pivotal movement about an axis which extends transversely of the normal path of movement of the vehicle, an electrical conductor extending transversely of said arm and movable with said arm, a pair of contact members carried by said housing and adapted to be interconnected by said conductor when said arm is in a vertical position, one of said contacts being connected to the battery of the vehicle and the other being connected to the rest of the electrical system of the vehicle, the upper end of said arm being free, weighted, and magnetically responsive, the lower end of said arm being fixed and pivotable, a pair of magnets carried by said housing to selectively retain the arm at one end or the other of its arc of swing to maintain the battery and the rest of the electrical system in disconnected relation, and means for variably controlling the amount of force required to swing said arm to disconnect the battery from the rest of the electrical system.

3. The safety switch of claim 2, said means comprising spring-pressed detents engageable within recesses formed in the lower end of said arm and adjustment means therefor threadably engaged with said housing, said recesses being elongated so that each detent is operable to restrain movement of said arm in one direction only.

4. The safety switch of claim 3, including means to re-set said arm to a vertical position, said means comprising a pivot shaft to which said arm is affixed, said shaft being supported for rotation by said housing and having a protruding tool-engageable end.

* * * * *